US005101995A

United States Patent [19]

Trubiano

[11] Patent Number: 5,101,995

[45] Date of Patent: Apr. 7, 1992

[54] WIRE-MESH MATERIAL HANDLING CONTAINER WITH IMPROVED LATCHES

[75] Inventor: Antoine Trubiano, Montreal, Canada

[73] Assignee: Cari-All, Inc., Quebec, Canada

[21] Appl. No.: 631,153

[22] Filed: Dec. 20, 1990

[51] Int. Cl.[5] ..... B65D 6/18

[52] U.S. Cl. ..... 220/7; 220/1.5; 220/485; 292/57; 292/DIG. 30

[58] Field of Search ..... 220/485, 6, 7, 1.5; 292/57, DIG. 30

[56] References Cited

U.S. PATENT DOCUMENTS

| | | | |
|---|---|---|---|
| 2,738,940 | 3/1956 | Coit, Jr. | 220/6 X |
| 2,783,911 | 3/1957 | Bussing | 220/7 |
| 2,806,623 | 9/1957 | Beckner | 220/6 |
| 2,806,624 | 9/1957 | Beckner | 220/6 |
| 3,372,829 | 3/1968 | Averill | 220/485 X |
| 3,907,150 | 9/1975 | Jurasek | 220/485 |
| 3,979,006 | 9/1976 | Jurasek | 220/485 |
| 3,981,410 | 9/1976 | Schurch | 220/6 |
| 4,050,606 | 9/1977 | Jurasek | 220/7 |
| 4,106,626 | 8/1978 | Trubiano | 206/513 |
| 4,629,086 | 12/1986 | Trubiano | 220/7 |

FOREIGN PATENT DOCUMENTS

| | | | |
|---|---|---|---|
| 2044338 | 10/1980 | United Kingdom | 220/485 |

*Primary Examiner*—Stephen P. Garbe
*Assistant Examiner*—Stephen Cronin
*Attorney, Agent, or Firm*—Longacre & White

[57] ABSTRACT

An improved material handling wire-mesh container having a bottom wall secured to a support frame, a rear and front wall hinged respectively to a rear and front edge of the bottom wall, and side walls hinged to a respective vertical end edge of the rear wall. Lock members are secured to the front wall adjacent opposed vertical edges thereof for locking the side walls and front wall in a vertical position with the rear wall disposed vertically. Each of the lock members has a latch secured to the front wall adjacent the vertical edge. The latch has a lock rod formed with a handle member and guidingly slidable in a keeper member so that the lock rod may be displaced axially. An arresting projection is secured to the lock rod for maintaining same in a lock position. Bolt receiving means is secured to each of the side walls for receiving a lock bolt end therein to secure the side walls to the front wall. The handle member has a stopper to restrict the axial displacement of the lock rod and permit axial rotation of the lock rod to engage and disengage the arresting projection. The handle pivots on the lock rod to permit full arcuate displacement of the handle over a front surface of the front wall.

8 Claims, 2 Drawing Sheets

WIRE-MESH MATERIAL HANDLING CONTAINER WITH IMPROVED LATCHES

BACKGROUND OF INVENTION:

1. Field of the Invention

The present invention relates to an improved lock member latch for use in material handling, wire-mesh containers.

2. Description of Prior Art

In my U.S. Pat. No. 4,629,086, there is described the construction of a collapsible and stackable material handling container which contains latches to secure the front wall erected with the side walls whereby all of the walls of the container are locked in a position of use. When the containers are not used, the walls are collapsed one on top of the other to form a pallet-type folded structure so that these structures can be piled one on top of the other. It has been found that when the walls are collapsed one on top of the other, often, the handle member of the latches becomes bent, twisted or broken for the reason that the handle member often becomes lodged and arrested in an angulated position above the front wall which is the first wall to be collapsed on the bottom wall. The side walls are then hinged on the rear wall and these three walls are then released to fall onto the bottom wall. This heavy load is applied to the handle member and bends it or breaks it. Reference is also made to U.S. Pat. No. 3,907,150 which shows the construction of a latch for such containers. FIG. 5 of that Patent illustrates the movement of the handle of the latch and shows that when it is fully open, the connecting web of the handle will abut against the wire mesh of the front wall to maintain it in an open position. Therefore, when the other walls are collapsed on this bottom wall with the handle in an open position, the handle will become damaged. Because of this, often, the container can no longer be locked in a useful position and the entire container is rendered inoperative.

SUMMARY OF INVENTION:

It is a feature of the present invention to provide an improved material handling, wire-mesh container having latches which substantially overcome the above-mentioned disadvantage of the prior art.

Another feature of the present invention is to provide an improved lock member for use in a material handling container of the wire-mesh type and which is provided with an improved latch construction.

Another feature of the present invention is to provide an improved lock member for a material handling container of the wire-mesh type and wherein the handle and lock bolt members are formed from a single metal rod bent in a common plane.

According to the above features, from a broad aspect, the present invention provides an improved material handling wire-mesh container having a bottom wall secured to a support frame, a rear and front wall hinged respectively to a rear and front edge of the bottom wall, and side walls hinged to a respective vertical end edge of the rear wall. Lock members are secured to the front wall adjacent opposed vertical edges thereof for locking the side walls and front wall in a vertical position with the rear wall disposed vertically. Each of the lock members has a latch secured to the front wall adjacent the vertical edge. The latch has a lock rod formed with a handle member and guidingly slidable in a keeper member so that the lock rod may be displaced axially.

Arresting means is secured to the lock rod for maintaining same in a lock position. Bolt receiving means is secured to each of the side walls for receiving a lock bolt end therein to secure the side walls to the front wall. The handle member has a stopper to restrict the axial displacement of the lock rod and permit axial rotation of the lock rod to engage and disengage the arresting means. The handle pivots on the lock rod to permit full arcuate displacement of the handle over a front surface of the front wall.

BRIEF DESCRIPTION OF DRAWINGS:

A preferred embodiment of the present invention will now be described with reference to the accompanying drawings in which.

Figure 1:
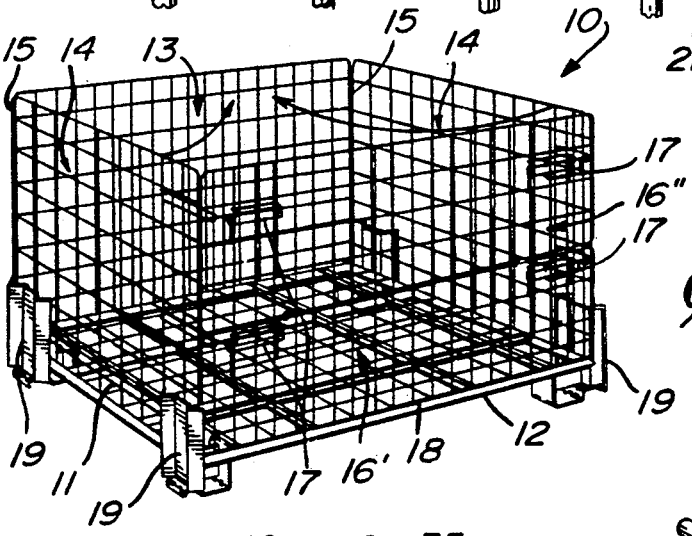
FIG. 1 is a perspective view of a wire-mesh material handling container having the improved lock members of the present invention.

DESCRIPTION OF PREFERRED EMBODIMENTS:

Referring to the drawings, and more particularly to FIG. 1, there is shown generally at 10, the improved material handling, wire-mesh container of the present invention. Such container is formed with a bottom wall 11 secured to a support frame 12, usually a reinforced support frame, for supporting loads positioned within the container. The container further has a rear wall 13 and opposed side walls 14 hinged to the rear wall along hinge edges 15. A front wall 16 is also provided and may be formed in two sections 16' and 16'' and each provided with opposed lock members 17 to secure the front wall(s) 16' and 16'' in an erected position as shown in FIG. 1. These lock members engage with the side walls 14 thus locking all of the walls in a vertical position for receiving material therein.

When the container 10 is not used, the lock members 17 are disengaged and the front wall which is hinged at its bottom edge 18 is collapsed on the bottom wall 11. The side walls 14 are folded on the back wall 13 and these three walls are then released forwardly to collapse on the front wall. A plurality of these collapsed containers are then stacked one on top of each other and supported in this position on their leg members 19. Usually, these containers are handled with a lift truck.

As previously described, a problem with these containers is that the lock members 17, because of their easy pivot displacement when subjected to shocks, often lodge themselves in an upward angulated position and break when the load formed by the folded side walls and rear wall are released onto the front wall with the lock members extending above the top surface.

Figure 2:
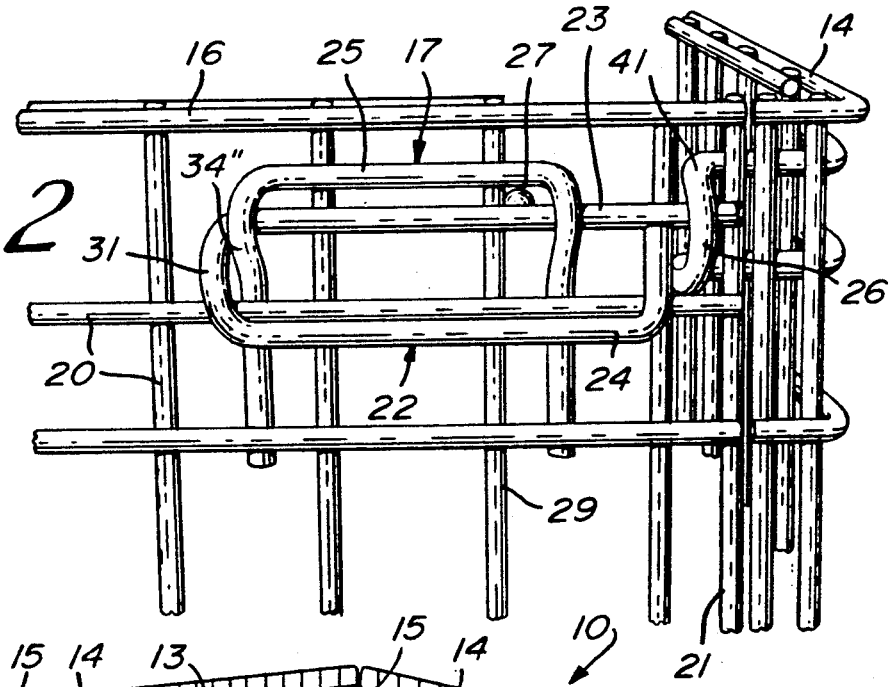
FIG. 2 is an enlarged view of a corner section of the front wall and vertical walls in their erected position showing the construction of a lock member of the present invention in its position of use.
Figure 3:
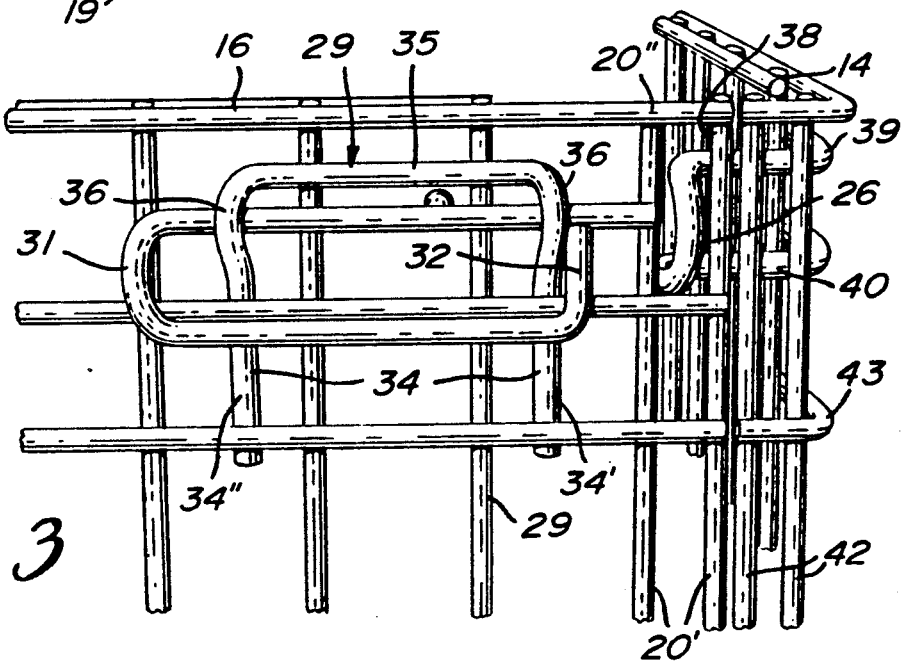
FIG. 3 is a view similar to FIG. 2 but showing the lock member in its open position.

The present invention is concerned with an improved lock member 17 as will now be described with reference to FIGS. 2 to 7. As shown in FIG. 2, the lock member 17 is secured to the wire meshing 20 of the front wall and adjacent opposed vertical edges or the outermost vertical edge rod 21 of the front wall 16 for locking the front wall and side walls 14 in a vertical position with the rear wall 13 also disposed vertically and retained in this position by its hinge edge engagement with the side walls. As herein shown, each of the lock members 17 is formed with a latch assembly 22 which is comprised of a lock rod 23 formed with a handle member 24. The lock rod 23 is guidingly slidable in a keeper member 25 so that the lock rod 23 may be displaced axially in and out of engagement with a bolt receiving loop 26, herein a wire loop attached to the side wall 14. The lock rod 23 is provided with an arresting projection 27 which is welded thereto for maintaining the lock rod 23 in a locked position, as shown in FIG. 2, or in an unlocked position, as shown in FIG. 3.

The handle member 24 is provided with stopper means by its loop formation whereby to restrict axial displacement of the lock rod and permit axial rotation of the lock rod to engage and disengage the arresting projection 27. As is better illustrated in FIGS. 4 and 5, the handle member 24 pivots on the lock rod 23 to permit full arcuate displacement of the handle over the front surface 28 of the front wall 16, see FIG. 5.

Figure 4:
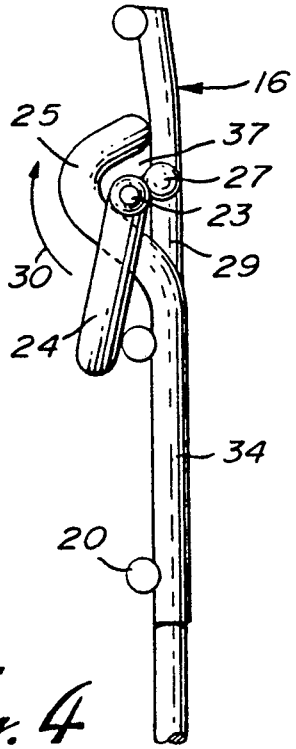
FIG. 4 is an end view of the latch member showing the handle extending downward with the arresting projection in a locking position.
Figure 5:
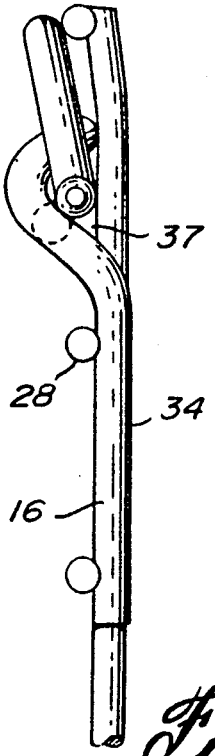
FIG. 5 is a view similar to FIG. 4 but showing the handle in an upward position resting against the front wall with the arresting projection in a disengaged position.
Figure 6:
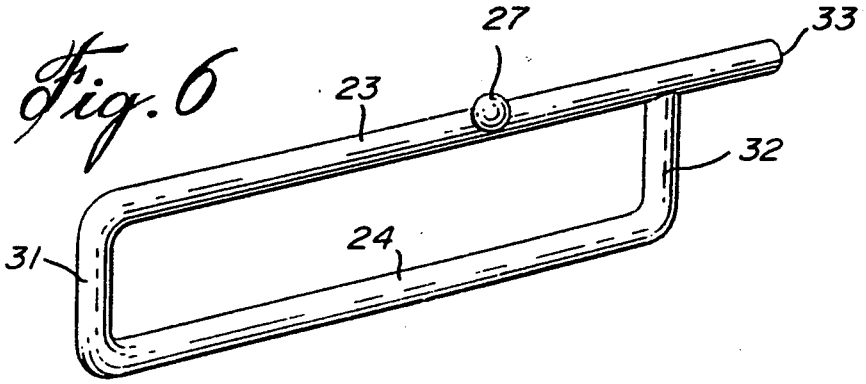
FIG. 6 is a perspective view illustrating the construction of the lock rod and handle member.

As is better illustrated in FIGS. 4 to 6, the arresting projection 27 is a steel ball welded at a predetermined position along and behind the lock rod 23. This projection extends rearwardly of the rod when the handle member is positioned in a depending position relative to the lock rod 23, as shown in FIG. 4. As also shown in this figure, the projection extends in the plane of the front wall 16 for abutment with an arresting vertical wire rod 29 as is better seen in FIG. 2. This wire rod 29 will restrict axial displacement of the lock rod 23 by preventing it from moving axially out of engagement with the bolt receiving loop 26. When the handle member is displaced arcuately in the direction of arrow 30, as shown in FIG. 4, that is to say, in an upward position, this causes axial rotation of the lock rod 23 and moves the projection 27 out of the plane of the front wall to permit the lock bolt to be retracted axially out of engagement with the bolt receiving loop 26. The handle can then be released downwardly again with the arresting projection disposed on the other side of the vertical rod 29.

As shown in FIG. 6, the handle member 24 and the lock rod 23 are formed from a single metal rod with the lock rod being a straight rod section. The handle member 24 is formed as a loop section thus defining a loop end 31, at a common end with the straight rod section, and a transverse abutment end 32 merging into the straight rod section 23 and welded thereto. The loop end 31 and the transverse abutment end 32 are spaced apart a predetermined distance with the abutment end 31 also being at a predetermined distance from the free end 33 of the lock rod 23. It is also pointed out that the handle member 24 and the lock rod 23 extend in a common plane. Accordingly, it is not necessary to bend the handle member outwards at a sloping angle as is the case with the prior art. It is therefore more simple and less costly to fabricate the latch member of the present invention. The lock rod 23 is retained captive for sliding and axial rotation displacement, as previously described, in a keeper member 25.

The keeper member 25 is formed of a single wire rod which is bent in a U-shape whereby to define opposed side arms 34 (see FIG. 3) and a base arm 35. The side arms 34 have a bend 36 adjacent the base arm 35 which when attached to the front wire-mesh wall 16 forms loops with the wire members 20 of the front wall 16 (see FIG. 4). These loops are better illustrated in FIG. 4 and designated by reference numeral 37. These loops or guide slots are disposed at predetermined distances from the vertical edge of the front wall to permit limited axial displacement of the lock rod relative to the vertical edge, as previously described.

As shown in FIGS. 2 and 3, the front wall 16 is provided with a loop receiving opening 38 defined between the pair of vertical wire rods 20' and a pair of horizontal wire rods 20'', whereby to receive therein the wire loop 26 projecting forwardly beyond a front edge of the adjacent side wall 14. Preferably, the lock bolt 23 extends across the vertical pair of wire rods 20' to provide for a more solid lock. The wire loop 26 is formed by an elongated U-shaped wire member 39 welded to the side wall 14. A front loop end 40 of the elongated U-shaped wire member 39 is bent inwardly of the container transverse to the side wall 14 and extends behind the plane of the front wall 16 when the front wall is in its vertically extending position, as shown in FIGS. 2 and 3. A free end portion 41 of the loop end 26 is bent forwardly again for reception in the loop receiving opening 38 of the front wall 16. As also shown in FIGS. 2 and 3, the side walls 14 have a reinforced front edge section 42 which is comprised of at least two spaced vertical wire rods retained by its welding engagement with the horizontal rods 43 of the side wall 14. The front loop end section 40 of the elongated U-shaped wire member 39 is welded to these vertical wire rods.

As shown in FIG. 3, the outermost side arm 34' which is closest to the vertical edge of the front wall, is disposed at a predetermined distance from the vertical edge of this front wall to abut with the abutment end 32 of the handle member 24 after the locking free end of the lock rod 23 is retracted from the bolt receiving loop 26. It is also noted that the arresting vertical wire rod 29, in the front wall 16, is spaced inwardly of the first or outermost side arm 34' a predetermined distance therefrom. A second side arm 34'' of the U-shaped wire member or keeper member 25 engages the loop end 31 of the handle member, as shown in FIG. 2, to limit engaging axial displacement of the lock rod and position the projection 27 in a transverse plane between the first side arm and the arresting vertical wire rod 29. The lock rod 23 is retracted to a disengaged position by lifting the handle to displace the projection outwardly of the front wall and then retract it through the loops 36. The handle is then released and falls downwardly by gravity. If the arresting projection 27 is aligned with the vertical wire rod 29, it will deflect from the rod due to its spherical outline and falls to the side thereof, as shown in FIG. 3. This will assure that the handle member 24 is always resting on the front wall whether the front wall is in a vertical position of use or in a horizontal position of non-use.

Figure 7:
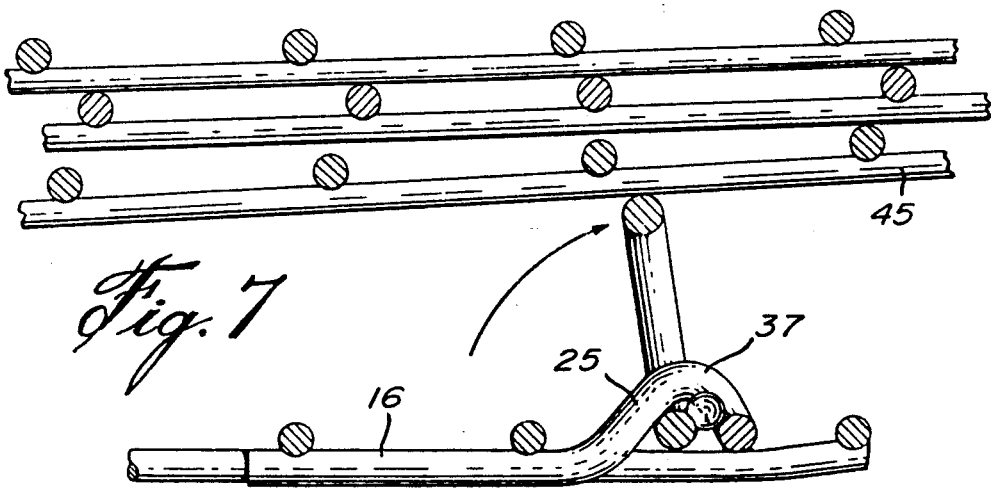
FIG. 7 is a fragmented side view showing the position of the handle member of prior art containers when the folded rear wall and side walls are released thereon during the collapsing of the container walls.

FIG. 7 shows a handle member of the prior art when the front wall 16 is collapsed on the bottom wall to a substantially horizontal position. As herein shown, the handle member 24 has been positioned at an upwardly angulated position by the jolt given to it by the impact of the front wall dropping on the bottom wall. Accordingly, the stack of folded side walls and rear wall, as designated by reference numeral 45, will damage the handle member which is held in an angulated position above the front wall 16. As previously described, the force of the dropping load on the handle will bend or break the handle member and accordingly render the lock member inoperative.

It is within the ambit of the present invention to cover any obvious modifications of the preferred embodiment described herein provided such modifications fall within the scope of the appended claims.

I claim:

1. An improved material handling wire-mesh container having a bottom wall secured to a support frame, a rear and front wall hinged respectively to a rear and front edge of said bottom wall, and side walls hinged to a respective vertical end edge of said rear wall; lock members secured to said front wall adjacent opposed vertical edges thereof for locking said side walls and front wall in a vertical position with said rear wall disposed vertically, each said lock member having a latch secured to said front wall adjacent said vertical edge, said latch having a straight lock rod formed with a handle member and with said straight lock rod guidingly slidable in a keeper member secured to said front wall and having a pair of loop wire members spaced apart a predetermined distance so that said lock rod may be displaced axially, arresting means secured to said lock for maintaining same in a locked position, bolt receiving means secured to each said side wall for receiving a straight free end of said lock bolt therein when slidingly displaced toward said bolt receiving means to secure said side walls to said front wall, said handle member having stopper means to restrict said axial displacement of said lock rod and permitting axial rotation of said lock rod to engage and disengage said arresting means, said handle pivoting on said lock rod to permit full arcuate displacement of said handle over a front surface of said front wall, said arresting means being a projection formed on said lock rod and extending rearwardly of said rod when said handle member is positioned in a depending position relative to said lock rod, said projection extending in the plane of said front wall for abutment with an arresting vertical wire rod therein to resist said axial displacement of said lock rod when in a locked position with said handle member depending, said handle member when displaced arcuately in an upward position causing said axial rotation of said lock rod and moving said projection out of said plane of said front wall to permit said lock bolt to be retracted axially out of engagement with said bolt receiving means of said adjacent side wall, said pair of loop wire members being secured to said front wall and extending outwardly thereof about said straight lock rod, said loop wire members being positioned at predetermined distances from said vertical edge of said front wall to permit limited axial displacement of said lock bolt relative to said vertical edge, a first of said loop wire members closest a vertical edge of said front wall being disposed at a predetermined distance from said vertical edge to abut an abutment end of said handle member after said straight free end is retracted from said bolt receiving means, said arresting vertical wire rod in said front wall being spaced inwardly of said first of said loop wire members at a predetermined distance therefrom, a second of said loop wire members engaging said loop end of said handle member to limit engaging axial displacement of said lock rod and positioning said projection on said lock rod in a transverse plane between said first of said loop wire members and said arresting vertical wire rod, said locking rod being retracted to a disengaged position by lifting said handle to displace said projection outwardly of said front wall and retracting said lock rod through said loops.

2. A container as claimed in claim 1 wherein said lock rod and said handle member are formed from a single metal rod, said handle member being formed by a loop section defining a loop end at a common end with said straight rod section, a spaced handle section and a transverse abutment end merging into said straight rod section spaced from a locking free end of said lock rod, said straight rod section and handle member extending in a common plane.

3. A container as claimed in claim 2 wherein said loop end and said abutment end constitutes said stopper means of said handle member.

4. A container as claimed in claim 1 wherein said loop wire members are formed from a single inverted U-shape wire member defining side arms and a base arm, said side arms having a bend adjacent said base arm to constitute said loops when said inverted U-shaped wire member is welded to wire members of said front wall, said bends projecting out of said front surface of said front wall.

5. A container as claimed in claim 2 wherein said front wall is provided with a loop receiving opening adjacent said vertical edge and aligned transversely to said locking free end of said lock bolt when in its locked position, said bolt receiving means of said side walls being a wire loop projecting forwardly beyond a front edge of said side walls and received in said loop receiving opening and extending therethrough to receive said locking free end of said lock rod with said locking free end spanning said loop receiving opening.

6. A container as claimed in claim 5 wherein said wire loop is formed by an elongated U-shape wire member welded to said side wall, a front loop end of said elongated U-shape wire member being bent inwardly of said container transverse to said side wall and extending behind the plane of said front wall when said front wall is vertically extending, a free end portion of said loop end being bent forwardly for reception in said loop receiving opening of said front wall.

7. A container as claimed in claim 6 wherein said side walls have a reinforced front edge having at least two spaced vertical wire rods, said front loop end of said elongated U-shape wire member being welded to said vertical wire rods.

8. A container as claimed in claim 1 wherein said projection is a ball-shaped projection, all of said container walls being formed of wire mesh, said arresting vertical wire rod being of circular cross-section, said ball-shaped projection causing deflection with said wire rods of said front wall to assure that said handle member is displaced against said front surface of said front wall in all positions of said front wall either erect or collapsed.

* * * * *